US008261556B2

(12) United States Patent
Audin et al.

(10) Patent No.: US 8,261,556 B2
(45) Date of Patent: Sep. 11, 2012

(54) DEVICE FOR GUIDING AN ELEMENT IN AN ORIFICE IN A WALL OF A TURBOMACHINE COMBUSTION CHAMBER

(75) Inventors: Patrick Audin, Corbeil-Essonnes (FR); Florian Andre Francois Bessagnet, Fresnes (FR); Pierre Pascal Sablayrolles, Cincinnati, OH (US); Guillaume Sevi, Ivry sur Seine (FR)

(73) Assignee: SNECMA, Paris (FR)

( * ) Notice: Subject to any disclaimer, the term of this patent is extended or adjusted under 35 U.S.C. 154(b) by 653 days.

(21) Appl. No.: 12/328,098

(22) Filed: Dec. 4, 2008

(65) Prior Publication Data

US 2009/0151361 A1 Jun. 18, 2009

(30) Foreign Application Priority Data

Dec. 14, 2007 (FR) ..... 07 08701

(51) Int. Cl.
*F02C 7/20* (2006.01)
*F02C 7/22* (2006.01)

(52) U.S. Cl. ..... 60/796; 60/798; 60/799; 60/800; 60/740; 60/39.821; 431/350; 431/351; 29/890.02

(58) Field of Classification Search ..... 60/39.821, 60/733, 752, 776, 796, 798, 799, 800, 740; 29/890.02; 431/350, 351
See application file for complete search history.

(56) References Cited

U.S. PATENT DOCUMENTS

| | | | | |
|---|---|---|---|---|
| 4,216,651 | A | 8/1980 | Ormerod | |
| 5,117,624 | A * | 6/1992 | Roberts et al. | 60/796 |
| 6,557,350 | B2 * | 5/2003 | Farmer et al. | 60/776 |
| 7,101,173 | B2 * | 9/2006 | Hernandez et al. | 431/258 |
| 7,140,189 | B2 * | 11/2006 | Markarian et al. | 60/796 |
| 2006/0042269 | A1 | 3/2006 | Markarian et al. | |
| 2008/0016874 | A1 | 1/2008 | Markarian et al. | |

FOREIGN PATENT DOCUMENTS

| | | | |
|---|---|---|---|
| EP | 1 342 954 | A1 | 9/2003 |
| EP | 1 770 332 | A1 | 4/2007 |

* cited by examiner

*Primary Examiner* — Ehud Gartenberg
*Assistant Examiner* — Steven Sutherland
(74) *Attorney, Agent, or Firm* — Oblon, Spivak, McClelland, Maier & Neustadt, L.L.P.

(57) ABSTRACT

A device for guiding an element in an orifice in a wall of a turbomachine combustion chamber is disclosed. The device includes a coaxial ring and bushing mounted one inside the other. The bushing includes two coaxial annular parts that are fastened to each other by welding and that define a groove for guiding a rim of the ring. Welding zones between the parts of the bushing are situated away from the path of the rim of the ring when moved along a privileged transverse direction of ring movement relative to the bushing when the combustion chamber is in operation.

10 Claims, 2 Drawing Sheets

Fig. 2
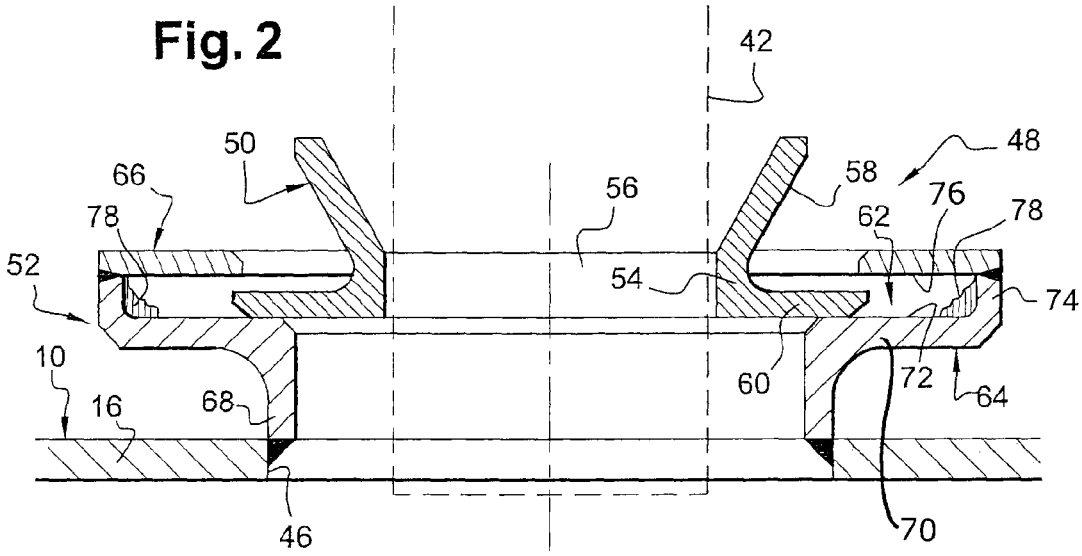
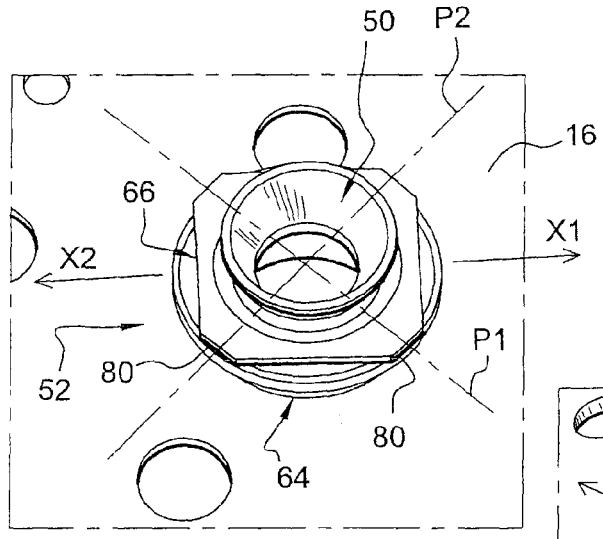
Fig. 3
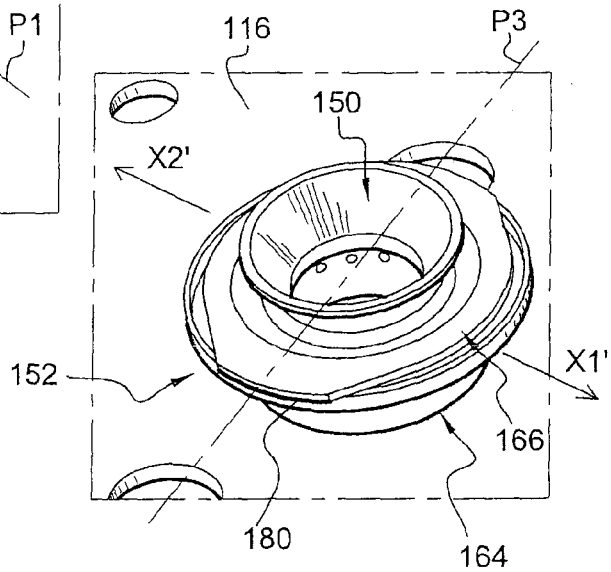
Fig. 4

DEVICE FOR GUIDING AN ELEMENT IN AN ORIFICE IN A WALL OF A TURBOMACHINE COMBUSTION CHAMBER

FIELD OF THE INVENTION

The present invention relates to a device for guiding an element such as an ignition spark plug or a fuel injector that extends through an orifice or in the vicinity of an orifice in a wall of a turbomachine combustion chamber.

BACKGROUND OF THE INVENTION

An annular combustion chamber of a turbomachine is defined by two walls in the form of bodies of revolution that are coaxial with one extending inside the other and that are connected together at their upstream ends by an annular end wall of the chamber.

The chamber end wall includes orifices for mounting means for injecting a mixture of air and fuel into the combustion chamber, the air coming from a compressor of the turbomachine and the fuel being delivered by injectors. The injectors extend substantially radially from their outer ends that are fastened on an outer casing of the combustion chamber, and they have heads that are aligned axially with the orifices in the chamber end wall.

The outer wall of the chamber includes at least one orifice for passing one end of an ignition spark plug, with the other end of the spark plug being fastened to an outer casing of the combustion chamber, said spark plug being used for initiating combustion of the air and fuel mixture inside the chamber.

During operation of the turbomachine, the walls of the combustion chamber expand thermally, thereby causing relative movement to take place between the outer wall of the combustion chamber and the ignition spark plug, and also between the chamber end wall and the fuel injectors.

In order to compensate for and allow these relative movements, guide devices are used for the spark plug and the injectors, each guide device comprising a ring and a bushing that are substantially coaxial, one being mounted inside the other, the ring being designed to have the spark plug or the injector passing axially therethrough and including an outer annular rim that is guided transversely in an inner annular groove in the bushing that is itself fastened to the edge of the orifice in the outer wall of the chamber or carried by the injection system. The bushing comprises two coaxial annular parts that are fastened to each other by welding and that define between them an annular groove for guiding the rim of the ring. European patent application EP-A1-1 770 332 in the name of the Applicant describes a guide device of that type.

The relative movements between the outer wall of the combustion chamber and the spark plug take place mainly in a direction parallel to the longitudinal axis of the combustion chamber. In operation, the bushing secured to the wall of the combustion chamber is thus moved essentially in said longitudinal direction relative to the ring for guiding the spark plug that is carried by the outer casing. The relative movements of the ring in the groove of the bushing in other transverse directions are of smaller amplitude. The axial or longitudinal direction is thus the privileged direction for movement of the ring for guiding the ignition spark plug relative to the bushing carried by the chamber.

Relative movements between the chamber end wall and the injectors take place mainly in directions that are radial relative to the longitudinal axis of the chamber, so the privileged direction for relative movement of the ring mounted around an injector is therefore a direction that is radial relative to the longitudinal axis of the combustion chamber.

In the prior art, the two annular parts forming the bushing of a guide device are fastened to each other at their outer peripheries by one or more welding beads extending around the entire outline of the bushing. Although the operator performing the welding operation takes great care in carrying out the welding, it is possible for the welding beads to spill into the annular groove for guiding the ring, thereby locally obstructing the outer periphery of the groove and thus reducing or preventing the ring from moving in a transverse direction in the groove of the bushing. The operation of welding the parts of the bushing is thus difficult to perform and does not enable welding spillage to be controlled. Furthermore, there is a significant risk of the device being blocked or jamming each time the rim of the ring comes into contact with a welding bead projecting into the groove of the bushing, with an associated unacceptable risk of the spark plug or the injector being broken.

One solution to that problem would be to overdimension the parts of the bushing so that the annular groove presents a transverse dimension that is greater than necessary in order to conserve sufficient clearance for movement of the ring in a transverse direction even when welding beads project into the inside of the groove.

Nevertheless, that solution is unsatisfactory since it leads to a significant increase in the weight of the device and it would impede ventilation of the wall of the combustion chamber by partially overlapping air-passing orifices in said wall situated in the vicinity of the device.

OBJECT AND SUMMARY OF THE INVENTION

A particular object of the invention is to provide a solution to this problem that is simple, effective, and inexpensive.

To this end, the invention provides a device for guiding an element in an orifice in a wall of a turbomachine combustion chamber, the device comprising a ring and a bushing that are substantially coaxial, one being mounted in the other, the ring being designed to have the element passing axially therethrough and having an outer annular rim that is guided transversely in an inner annular groove of the bushing that is designed to be fastened to the edge of the orifice in the wall of the combustion chamber, the bushing comprising two coaxial annular parts fastened to each other by brazing or welding and defining between them the annular groove for guiding the rim of the ring, and the device having at least one privileged transverse direction for movement of the ring, wherein the two parts of the bushing are fastened to each other via welding or brazing zones, these zones lying away from the path followed by the rim of the ring when it moves relative to the bushing in the privileged direction.

According to the invention, the two zones of welding or brazing between the two parts of the bushing are not situated on the privileged direction of ring movement, so any spillage of welding or brazing beads penetrating into the groove of the bushing and locally obstructing it will not limit movement of the rim of the ring in the privileged direction. There is therefore no need to make allowance for projections of welding beads when dimensioning the bushing of the guide device. In a particular embodiment of the invention, this makes it possible to reduce the diameter of the bushing by about 2 millimeters (mm) compared with the prior art.

Preferably, the welding or brazing zones are distributed around the axis of the bushing.

There may be two of these zones, which zones are then diametrically opposite about the axis of the bushing. By way of example, one of the two parts of the bushing is a washer having an outline that is substantially oval or oblong, the washer having end portions of smaller radius of curvature that are brazed or welded to the other part of the bushing. This particular shape for the washer of the bushing enables the weight of the device to be reduced. Advantageously, the welding or brazing zones are in alignment on an axis that is substantially perpendicular to the privileged direction of ring movement.

In a variant, there are four welding or brazing zones that are diametrically opposite one another in pairs about the axis of the bushing. By way of example, one of the two parts of the bushing is a washer of outline that is substantially square in shape so as to reduce the weight of said part, the washer having end portions corresponding to the vertices of the square that are brazed or welded to the other part of the bushing. The diametrically opposite welding zones are aligned on axes that are inclined by an angle of about 45° from the privileged direction of ring movement.

The present invention also provides a turbomachine combustion chamber, including at least one device as described above, and a turbomachine, such as an airplane turboprop or turbojet, including at least one turbine of said type.

BRIEF DESCRIPTION OF THE DRAWINGS

The invention can be better understood and other characteristics, details, and advantages thereof appear more clearly on reading the following description made by way of non-limiting example with reference to the accompanying drawings, in which:

FIG. 2 is a diagrammatic view of a guide device of the prior art;

FIG. 3 is a diagrammatic perspective view of a guide device of the invention; and FIG. 4 is a diagrammatic perspective view of a variant embodiment of the device of the invention.

MORE DETAILED DESCRIPTION

Figure 1:
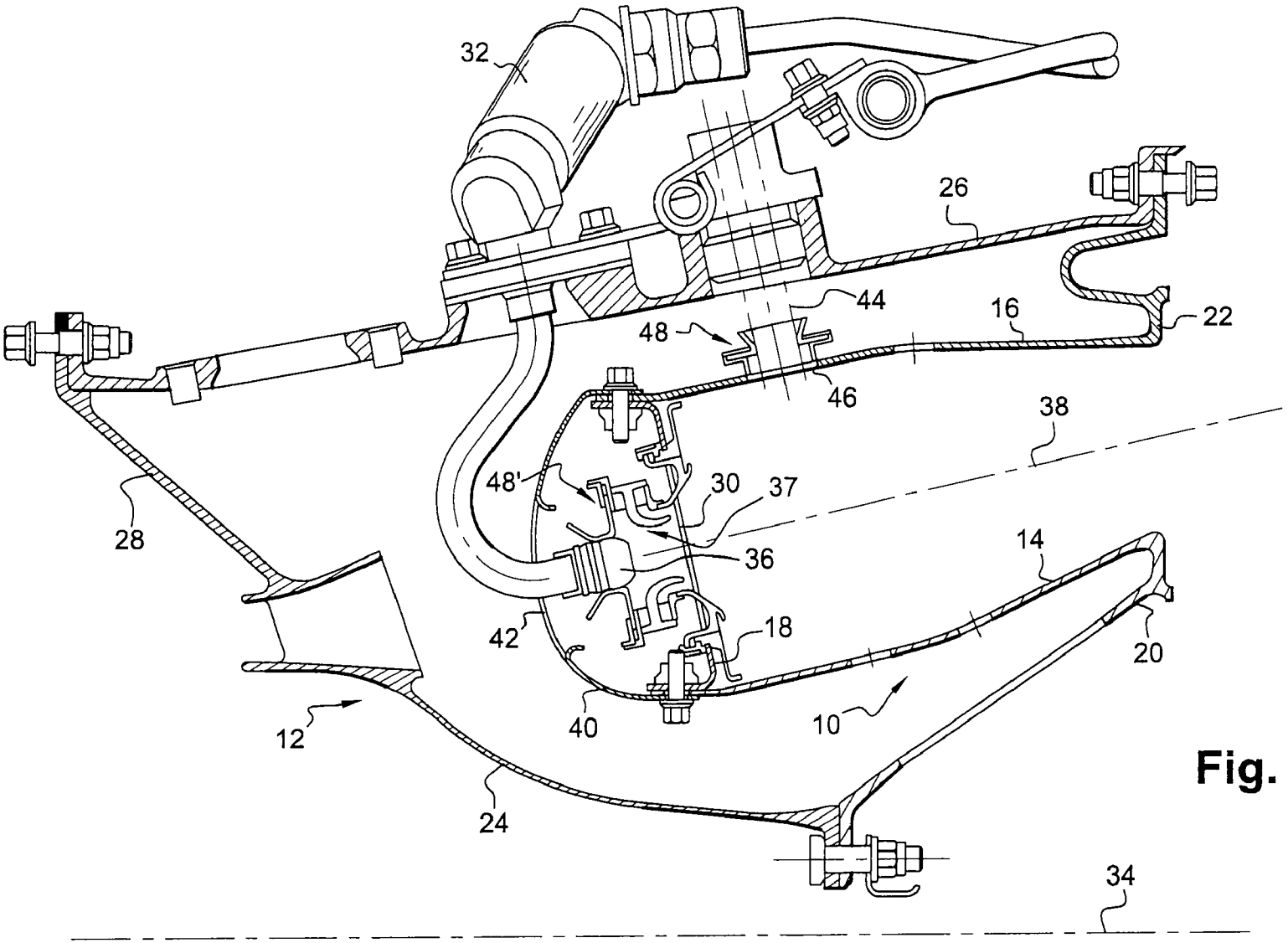
FIG. 1 is a diagrammatic half-view in axial section of a diffuser and a combustion chamber of a turbomachine.

With reference initially to FIG. 1, there can be seen an annular combustion chamber 10 for a turbomachine such as an airplane turbojet, arranged at the outlet from an annular diffuser 12, itself situated at the outlet from a compressor (not shown).

The chamber 10 comprises an inner wall 14 and an outer wall 16 both in the form of bodies of revolution, which walls are connected together at their upstream ends by an annular chamber end wall 18, and are fastened at their downstream ends via inner and outer annular flanges 20 and 22 respectively to an inner frustoconical partition 24 of the diffuser and to a downstream end of an outer casing 26 of the combustion chamber, the upstream end of said casing 26 being fastened to an outer frustoconical partition 28 of the diffuser.

The chamber end wall 18 includes orifices 30 for mounting systems 37 to inject a mixture of air and fuel into the chamber 10, the air coming from the diffuser 12 and the fuel being delivered by injectors 32. The injectors 32 have their radially outer ends fastened to the outer casing 26 and they are regularly distributed around a circumference about the axis of revolution 34 of the chamber. Each injector 32 has a fuel injector head 36 at its radially inner end, which head is guided in an injection system 37 and is in alignment on the axis 38 of an orifice 30 corresponding to the chamber end wall 18, this axis 38 coinciding in the drawing with the longitudinal axis of the chamber section.

An annular cap 40 that is curved in the upstream direction is fastened to the upstream ends of the walls 14, 16, and 18 of the chamber and includes orifices 42 for passing air in alignment with the orifices 30 in the chamber end wall 18.

The mixture of air of fuel that is injected into the chamber 10 is ignited by means of at least one ignition spark plug 44 that projects radially outwards from the chamber. The radially inner end of the spark plug 44 is guided in an orifice 46 in the outer wall 16 of the chamber, and its radially outer end is fastened by suitable means to the outer casing 26 and is connected to electrical power supply means (not shown) situated outside the casing 26.

A device 48 for guiding the radially inner end of the ignition spark plug 44 is fastened to the outside of the chamber 10 on the outer wall 16 around the orifice 46 in order to compensate for relative displacements that take place between the chamber outer wall 16 and the spark plug 44 carried by the casing 26 while the turbomachine is in operation. These relative displacements take place mainly in a longitudinal direction, i.e. substantially parallel to the axis 38 of the chamber 10.

A device 48' for guiding the head 36 of the injector is also carried by each injection system 37 mounted in an orifice 30 of the chamber end wall 18, in order to compensate for relative displacements between the chamber and the injector, which displacements take place mainly in a radial direction relative to the axis 38.

As can be seen more clearly in FIG. 2, the guide device 48 (48') comprises a ring 50 with the spark plug 44 (or the injector head 36) passing axially therethrough, the ring being mounted inside one end of a coaxial bushing 52 whose other end is fastened to the outer wall 16 of the chamber by brazing, welding, or the like around the sparkplug-passing orifice 46 (or is fastened to the injection system 37 carried by the chamber end wall 18).

The ring 50 has a cylindrical portion 54 with an inside surface 56 surrounding the spark plug 44 (or the injector head 36) with small clearance. This cylindrical portion 54 is connected at one end to a frustoconical portion 58 that flares outwards and that serves to guide the spark plug (or the head) while it is being mounted in the device, and at its other end it has an annular rim 60 that extends radially outwards from the axis of the ring 50 and that is guided in an inner annular groove 62 of the bushing 52.

The bushing 52 comprises two coaxial annular parts 64 and 66 that are fastened to each other by brazing or welding and that define between them the annular groove 62 for guiding the outer rim 60 of the ring 50. In the example shown, the bushing 52 comprises a first annular part 64 of substantially S- or Z-shaped section, and a second annular part 66 that is plane and constituted by a washer.

The first part 64 has a cylindrical wall 68 that is welded or brazed at one end to the wall 16 (or the injection system 37) and that is connected at its other end to a radial wall 70 defining an inner annular surface 72 of the groove 62. The radial wall 70 of the part 64 is connected at its outer periphery to a cylindrical rim 74 extending from the opposite side to the cylindrical wall 68 and that has the periphery of the washer 66 of the bushing applied and welded or brazed thereto. The washer 66 extends substantially radially relative to the axis of the bushing and defines another inner annular surface 76 of the groove, this surface 76 being parallel to the surface 72 defined by the first part 64 of the bushing. The annular surfaces 72 and 76 enable the outer rim 60 of the ring to be guided in a plane that is radial or transverse relative to the axis of the bushing.

The outside diameter of the annular rim 60 of the ring 50 is smaller than the inside diameter of the cylindrical rim 74 of the bushing 52, and the outside diameter of the cylindrical portion 54 of the ring is smaller than the inside diameter of the washer 66 so as to allow the rim 60 of the ring to move in a transverse plane within the groove 62. The axial size or thickness of the outer rim 60 of the ring is also smaller than the axial size of the groove 62 in the bushing so as to allow the axes of the ring 50 and of the bushing 52 to be offset angularly.

Nevertheless, during the operation of welding or brazing the outer periphery of the washer 56 to the cylindrical rim 74, molten material 78 penetrates into the inside of the groove 62 of the bushing and can obstruct this groove locally over at least a fraction of its periphery, thereby reducing the clearance available for the ring 50 in a transverse direction inside the groove.

The invention enables this problem to be remedied by welding or brazing the washer 66 and the part 64 of the bushing in circumferential zones that are spaced apart from each other and that are remote from the privileged direction for movement of the rim of the ring in operation.

In the embodiment shown in FIG. 3, the washer 66 is fastened to the part 64 via four welding or brazing zones 80 that are regularly distributed around the axis of the bushing. Each of these welding zones 80 may be formed by one or more spot welds or by a welding bead extending over a small angular extent around the axis of the bushing (e.g. of the order of about 20°).

The welding zones 80 are diametrically opposite in pairs about the axis of the bushing. Two diametrically opposite zones 80 are in alignment on an axis P1 (or P2) perpendicular to the axis of the bushing. In the embodiment of the invention as shown, the axes P1 and P2 are offset by 45° clockwise and counterclockwise from the privileged directions X1 and X2 of relative movement of the ring.

For the guide device 48 for guiding the spark plug 44, the privileged direction of relative movement for the ring is the longitudinal direction along the axis 38, with movements of the ring taking place in this direction either upstream (X1) or downstream (X2).

For the guide device 48' for guiding the injector head 36, the privileged direction for guiding the ring is the radial direction relative to the axis 38, the movements of the ring taking place in this direction either outwards (X1) or inwards (X2).

In the example shown, the shape of the washer 66 is optimized in order to reduce its weight. The washer 66 has an outline that is substantially square in shape with its vertices applied against and welded to the zones 80 on the cylindrical rim 74 of the bushing part 64. The edges of the square outline of the washer 66 do not bear against the cylindrical rim 74 and are spaced apart from said rim radially inwards so as to leave spaces for passing ventilation air between the washer 66 and the cylindrical rim 74 of the part 64.

In the variant shown in FIG. 4, the washer 166 is fastened to the outer rim 174 by two welding or brazing zones 180 that are diametrically opposite, each extending over an angular extent of the order of about 40°. In the invention, these welding zones 180 are offset from the privileged direction X1, X2 of movement of the ring. This direction X1, X2 may be the longitudinal direction when guiding a spark plug 44, or the radial direction when guiding the head 36 of an injector.

In the example shown, the welding zones 180 are aligned on an axis P3 that is substantially perpendicular to said privileged direction X1, X2.

The washer 166 is oval or oblong in shape with the tips corresponding to the ends having smaller radius of curvature being brazed or welded on the cylindrical rim 174 of the part 164. The lateral portions of the washer 166 correspond to its ends of larger radius of curvature and they are spaced apart from and radially set back inwards relative to the cylindrical rim 174 of the bushing, thereby leaving spaces for passing air between the washer 166 and the rim 174.

The ring 50, 150, the part 64, 164, and the washer 66, 166 of the device may be made of a cobalt-based alloy, for example.

What is claimed is:

1. A device for guiding an element in an orifice in a wall of a turbomachine combustion chamber, the device comprising:

a ring and a bushing that are substantially coaxial, one being mounted in the other, the ring being designed to have the element passing axially therethrough and having an outer annular rim that is guided transversely in an inner annular groove of the bushing that is designed to be fastened to the edge of the orifice in the wall of the combustion chamber, the bushing comprising two coaxial annular parts fastened to each other by brazing or welding and defining between them the annular groove for guiding the rim of the ring, and the device having at least one privileged transverse direction for movement of the ring, wherein one of the two parts of the bushing is a washer having an outer peripheral edge having at least two portions which are fastened via welding or brazing to the other of the two parts of the bushing and at least two portions which are not fastened to the other of the two parts of the bushing, said at least two non-fastened portions being diametrically opposite about an axis of the bushing and being in alignment on an axis which is parallel to the at least one privileged transverse direction for movement of the ring, said at least two fastened portions being regularly distributed around the axis of the bushing, and wherein the other of the two parts of the bushing comprises a continuous cylindrical rim extending around the outer annular rim of the ring, said at least two non-fastened portions being free of contact against said continuous cylindrical rim and are located radially inward thereto and spaced apart therefrom, so as to leave spaces for passing and guiding ventilation air between the washer and the continuous cylindrical rim.

2. A device according to claim 1, wherein the at least two fastening portions are distributed around the axis of the bushing.

3. A device according to claim 2, wherein the at least two fastening portions are diametrically opposite about the axis of the bushing.

4. A device according to claim 3, wherein the washer has a substantially oval or oblong outline, said washer having opposite end portions of smaller radius of curvature that are brazed or welded to the other part of the bushing.

5. A device according to claim 3, wherein the at least two fastening portions are in alignment on an axis that is substantially perpendicular to the privileged direction of ring movement.

6. A device according to claim 2, wherein said fastening portions are four in number and are diametrically opposite in pairs about the axis of the bushing.

7. A device according to claim 6, wherein the washer has an outline that is substantially square in shape, the washer having end portions corresponding to the vertices of the square that are brazed or welded to the other part of the bushing.

8. A device according to claim 6, wherein the diametrically opposite fastening portions are aligned on axes that are inclined at an angle of about 45° relative to the privileged direction of ring movement.

9. A turbomachine combustion chamber, including at least one device according to claim 1 for guiding an ignition spark plug or a fuel injector.

10. A turbomachine including a combustion chamber according to claim 9.

* * * * *